US009739115B2

(12) United States Patent
Carrejo

(10) Patent No.: US 9,739,115 B2
(45) Date of Patent: Aug. 22, 2017

(54) DEGRADABLE FLUID LOSS AND PRESSURE BARRIER FOR SUBTERRANEAN USE

(71) Applicant: BAKER HUGHES INCORPORATED, Houston, TX (US)

(72) Inventor: Nicholas Carrejo, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 450 days.

(21) Appl. No.: 14/285,123

(22) Filed: May 22, 2014

(65) Prior Publication Data

US 2015/0337623 A1 Nov. 26, 2015

(51) Int. Cl.
*E21B 34/06* (2006.01)
*E21B 29/02* (2006.01)

(52) U.S. Cl.
CPC ..... *E21B 34/063* (2013.01); *E21B 29/02* (2013.01)

(58) Field of Classification Search
CPC ..... E21B 34/063
See application file for complete search history.

(56) References Cited

U.S. PATENT DOCUMENTS 2,765,854 A * 10/1956 Lewis ..... E21B 33/14 166/212
3,957,115 A 5/1976 Kerzee et al.
5,526,881 A 6/1996 Martin et al.
6,047,773 A * 4/2000 Zeltmann ..... E21B 21/14 166/281
6,145,593 A * 11/2000 Hennig ..... E21B 29/06 166/177.6
6,237,688 B1 5/2001 Burleson et al.
7,810,567 B2 10/2010 Daniels et al.
8,020,620 B2 9/2011 Daniels et al.
9,394,766 B2 * 7/2016 Holderman ..... E21B 43/08
9,410,413 B2 * 8/2016 O'Brien ..... E21B 43/261
2005/0155772 A1 * 7/2005 Dusterhoft ..... E21B 43/084 166/381
2012/0132426 A1 * 5/2012 Xu ..... E21B 21/10 166/308.1
2013/0025876 A1 * 1/2013 McCoy ..... E21B 43/26 166/373
2014/0069652 A1 * 3/2014 Gay ..... E21B 41/0057 166/308.1

(Continued)

*Primary Examiner* — Shane Bomar
(74) *Attorney, Agent, or Firm* — Steve Rosenblatt

(57) ABSTRACT

A tubular segment that has openings that are initially closed so that pressure can be conducted through the segment has the ability to open the segments by making a degradable material unblock the openings to facilitate another completion operation or production. Some applications include a slotted liner with a screen where an intermediate layer of a controlled electrolytic material initially allows the structure to conduct pressure and then after degradation allows access through the screen and the slotted liner for production. Other variations can be simply using slotted liner where the slots are closed for running it to allow circulation and then opened for production or other completion steps. The transformation can take place over time using available well fluids or it can take place with induced well conditions at the location that are initiated from the surface or locally at the location.

17 Claims, 3 Drawing Sheets

(56) References Cited

U.S. PATENT DOCUMENTS

| | | | | |
|---|---|---|---|---|
| 2014/0246209 | A1* | 9/2014 | Themig | E21B 43/14 166/374 |
| 2015/0129205 | A1* | 5/2015 | Hofman | E21B 34/14 166/250.01 |
| 2015/0226041 | A1* | 8/2015 | Holderman | E21B 43/08 166/386 |

* cited by examiner

DEGRADABLE FLUID LOSS AND PRESSURE BARRIER FOR SUBTERRANEAN USE

FIELD OF THE INVENTION

The field of the invention is degrading tubular wall barriers that can be selectively removed to facilitate an independent subterranean operation using a tubular string extending to a subterranean location.

BACKGROUND OF THE INVENTION

In some completions it is desirable to control fluid loss into the formation. One way this is done is to have closures over tubular wall openings until the time arrives when such openings need to be operated to allow alternative access through the wall openings. One example of this is when running in a screen assembly with an isolation device. In some applications the access through the screens is closed off inside the string with sliding sleeve valves. These valves later need an intervention to be operated such as a sleeve shifting tool or the sliding sleeves themselves have to be configured to respond to predetermined pressures to operate in a sequence as determined with rupture discs that break at sequentially higher pressures. A mechanical intervention or configuring sleeves to open at predetermined pressures has several disadvantages. The physical intervention takes time that cost money in well downtime and rigs and personnel to accomplish the intervention. Pressure operated sleeves need a piston area to push them to an open position which means the drift diameter of the production string is reduced. Slowing production is costly and can limit the total amount produced from the borehole during its useful life.

The present invention addresses these issues by blocking devices that would otherwise present openings in the wall of the borehole so that fluids can be delivered under pressure to other equipment further down the string or to facilitate circulation or reverse circulation when running in the string or trying to get the string unstuck if it happens to stick when running in. The openings in downhole equipment such as screens can then be opened with a degradable material that goes away with existing or imposed well conditions. Access is then opened through the string through equipment previously sealed to retain internal pressure in the string. Further completion operations can be accomplished or production can begin. Preferably a controlled electrolytic material is used as the material that degrades to open passages through a tubular wall. Controlled electrolytic materials have been described in US Publication 2011/0136707 and related applications filed the same day. The related applications are incorporated by reference herein as though fully set forth. Those skilled in the art will more readily appreciate these and other aspects of the invention from a review of the description of the preferred embodiment and the associated drawings while recognizing that the full scope of the invention is to be determined from the appended claims.

SUMMARY OF THE INVENTION

A tubular segment that has openings that are initially closed so that pressure can be conducted through the segment has the ability to open the segments by making a degradable material unblock the openings to facilitate another completion operation or production. Some applications include a slotted liner with a screen where an intermediate layer of a controlled electrolytic material initially allows the structure to conduct pressure and then after degradation allows access through the screen and the slotted liner for production. Other variations can be simply using slotted liner where the slots are closed for running it to allow circulation and then opened for production or other completion steps. The transformation can take place over time using available well fluids or it can take place with induced well conditions at the location that are initiated from the surface or locally at the location.

DETAILED DESCRIPTION OF THE PREFERRED EMBODIMENT

The concept of the present invention is to provide one or more components of a tubular string that are designed to control fluid loss by keeping wall openings closed for a predetermined time and then allow the covering for those openings to degrade or otherwise stop from covering the openings so that fluid can be moved through the openings for a variety of purposes.

Figure 1:
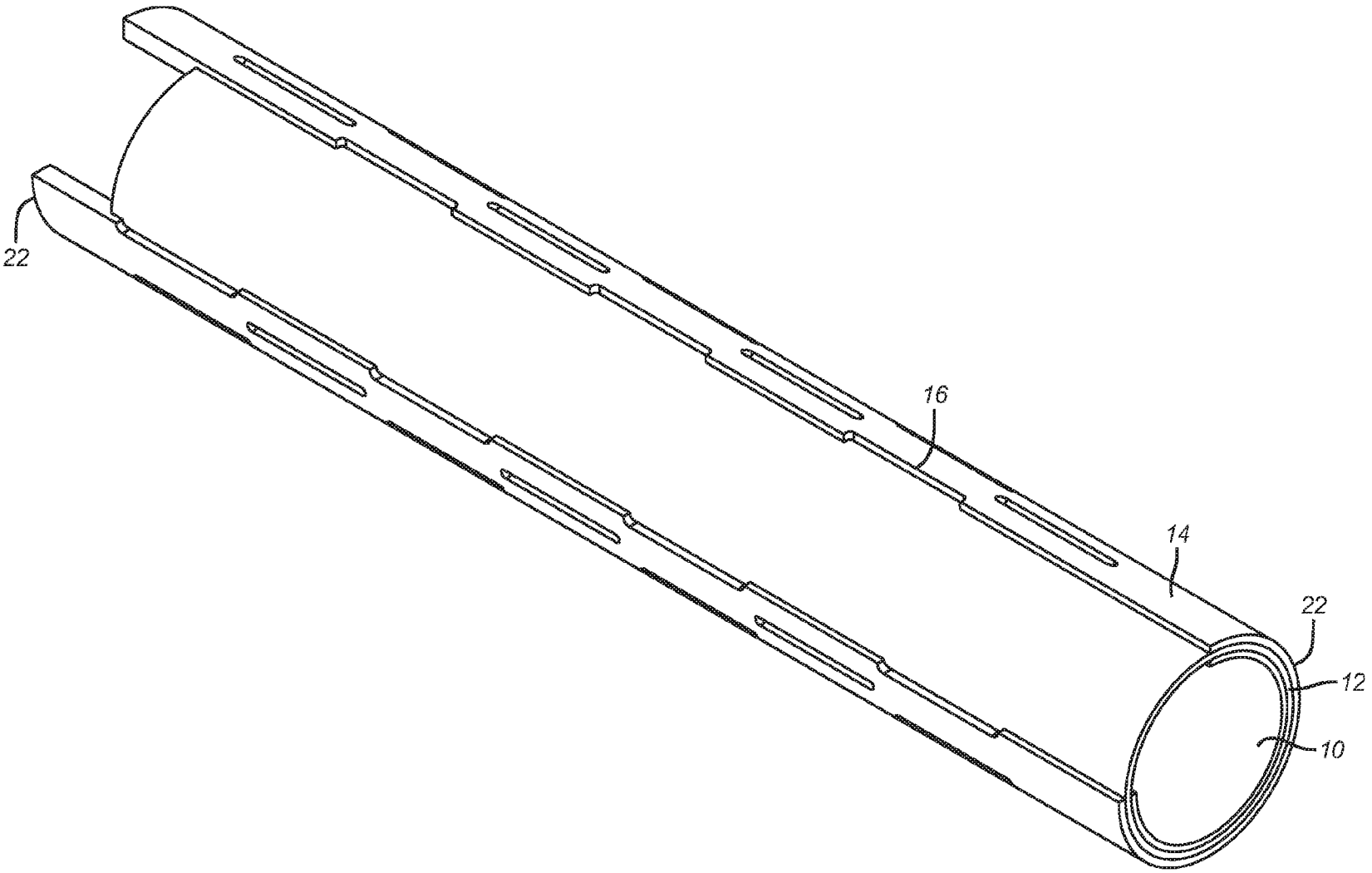
FIG. 1 is a perspective view that is part cut away to show the layered construction of the tubular segment.
Figure 2:
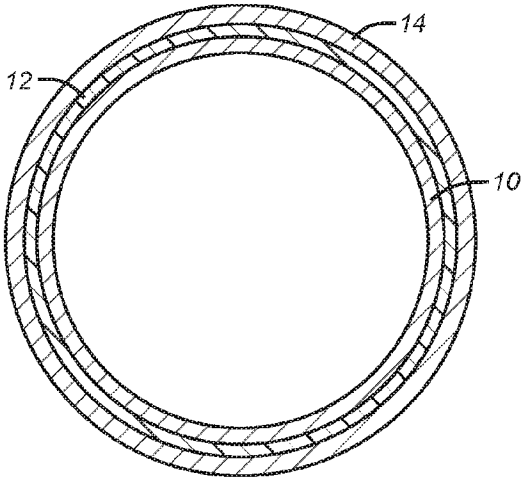
FIG. 2 is a transverse section through the view in FIG. 1.
Figure 3:
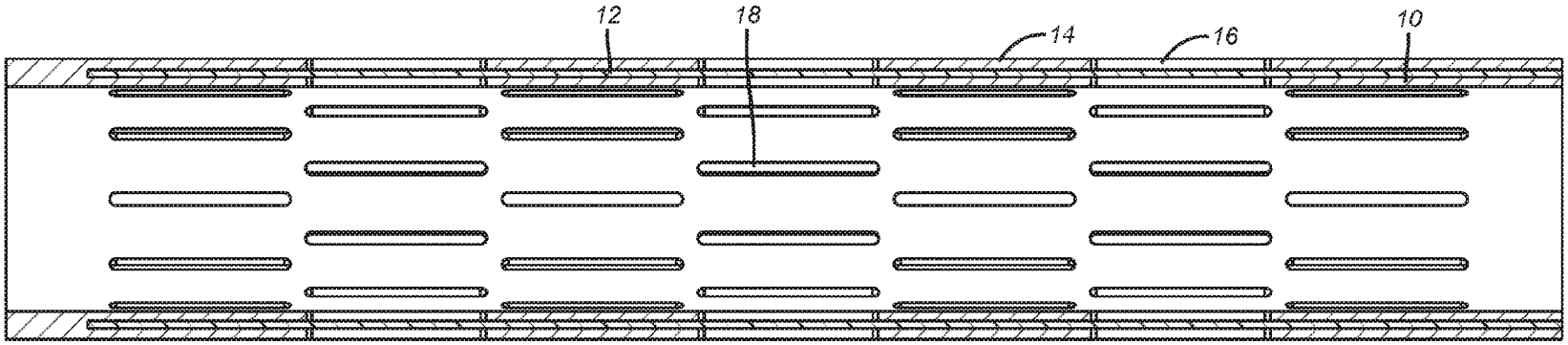
FIG. 3 is an interior section view of the view of FIG. 1.
Figure 4:
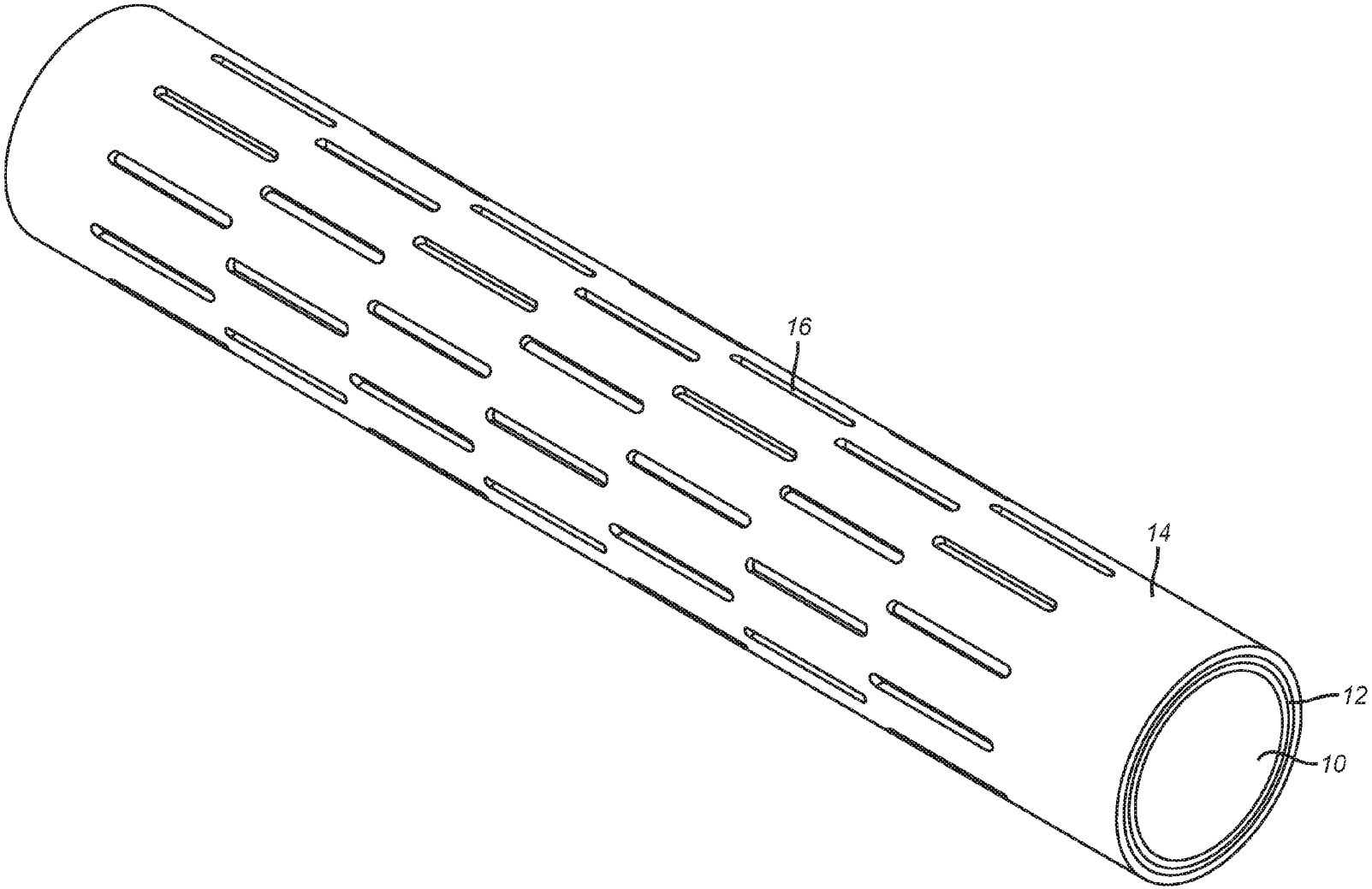
FIG. 4 is an exterior perspective of the view of FIG. 1 without any cutaway.

FIG. 1 illustrates a built up layer design with an inner tubular 10 followed by a degradable layer 12 and then an outer tubular 14 that has openings such as slots 16. The inner tubular has openings such as slots 18 that preferably align or at least partially overlap openings 16 in the outer tubular 14. Opposed ends 20 and 22 have connections mounted to them that are not shown to allow the illustrated segment to be attached to a tubular string by threads or other types of connections. The illustrated structure in the FIGS. can be made to lengths common in the oilfield to facilitate handling by existing rig equipment or other surface tubular handling equipment. While a single section is illustrated it is also envisioned to connect together as many sections as desired to form an interval of openings that are long enough to adequately service the predetermined locations for the intended subsequent use as will be discussed below. A given tubular string can also have spaced intervals of the perforated pipe in the FIGS. with each interval being a length desired and the spacing among intervals determined by the conditions at a given well. While elongated slots are illustrated in the FIGS., the openings can vary in shape and arrangement different from the array of parallel rows of slots with offset slots in adjacent rows as looked at circumferentially. Instead, the openings can be round holes that are circumferentially and/or axially spaced in a single or multiple rows or even in a random arrangement. Alternatively the openings can be in the form of a mesh or other type of screen material.

The ability to open flow between openings 16 and 18 can be accomplished in a variety of ways. One way is to degrade the layer 12 with fluid in the borehole or added to the borehole. Another way is to raise the internal pressure to a predetermined level to fail the layer 12 to start the ability to flow through and continue the process with introduced fluid like an acid to continue to further open the openings through degradation of the layer 12.

In another alternative the layer 12 can be the innermost layer as opposed to being sandwiched between two structural layers as shown in the FIGS. In that arrangement, the degradable layer can be degraded away to expose openings or it can also be configured to be pushed away from the openings on pressure buildup above a predetermined value and then degraded to simply disappear to ensure that debris is not left behind and that all the openings are in fact available for flow. The layer 12 as an innermost layer can also be located in a wide spot in the tubular to avoid reducing the drift dimension in the string as well as to protect the layer 12 when other tools are passed through the string. Recessing the layer 12 also cuts the erosion wear from high velocity fluids or entrained solids such as proppant or drilling fluid that are contained in the flowing fluid.

The purpose of the design being described is to prevent fluid loss so that another operation is enabled while allowing for subsequent opening of the wall ports to then accomplish another completion operation or production or injection. For example, casing can be drilled in and the illustrated devices can be in the string to allow pressurized fluid to go to the drill bit to make hole and advance the casing to the desired location. When the proper depth is reached the covering for the openings in the casing can be degraded or otherwise removed as described above and the open hole borehole can be either put on production or injection service, for example. Another application is fracturing where the openings are initially closed to allow circulation for running in the string and setting a packer followed by sequential opening, fracturing through the openings and isolating already fractured zones as additional zones are fractured. Another potential application is screen gravel packing where circulation is used to assist in running in the assembly, followed by gravel slurry that carries fluid to degrade the material covering the screen to allow return flow and gravel deposition.

One advantage to use of the degradable material is that there is no waste material that is left behind to potentially impact the operation of adjacent downhole equipment. There is also no need for a physical intervention as the existing well fluids may allow sufficient blockage time to avoid fluid loss before automatically opening the openings by degrading the cover material, which is preferably a controlled electrolytic material or CEM or a degradable polymer or composite.

As an alternative to a sleeve that covers multiple openings, other options are possible for temporary obstruction of the openings to prevent fluid loss for a time. The CEM material or other degradable material can be secured in the openings with threads or snap rings in grooves. The connection can be fluid tight or permit some minimal leakage as long as pressure is adequately transmitted to other downhole components such as nozzles to a casing drilling bit, for example.

The process for the removal of the barrier of the degradable material from the openings can take place automatically or by virtue of actions taken from the surface such as by addition of a material that will initiate the degrading process. In the sandwich design shown in the FIGS. the parts of layer 12 that is at the openings will degrade initially. While some further degradation that is offset from the openings can continue, most of the layer 12 will remain intact between the openings so as to maintain the spacing between inner and outer tubulars 10 and 14.

Once the openings are opened, fracturing, acidizing, treating, injection or production or other operations can take place with flow through the openings.

The above description is illustrative of the preferred embodiment and many modifications may be made by those skilled in the art without departing from the invention whose scope is to be determined from the literal and equivalent scope of the claims below:

I claim:

1. A tubular apparatus configured for connection to a tubular string extending to a subterranean location, said tubular string comprising a wall defining an outer surface and an innermost passage extending the length of the tubular string therethrough and defined on an opposite side of said wall from the outer surface, comprising:

at least one elongated tubular body having opposed ends for mounting to the tubular string in at least one location making said body a continuation of the innermost passage of the tubular string, said body comprising at least one cover over at least one wall opening, said cover comprising an elongated tubular shape located within said innermost passage or in the wall of said body, said cover further comprises a degradable material, to block flow in opposed directions so that pressure can be conducted between said opposed ends;

said degradable material selectively opening said at least one wall opening while having remained in a fixed position relative to the tubular string for fluid flow through said wall opening.

2. The apparatus of claim 1, comprising:

said at least one opening comprises a plurality of openings that are axially spaced.

3. The apparatus of claim 2, comprising:

said at least one opening comprises a plurality of openings that are circumferentially spaced.

4. The apparatus of claim 2, comprising:

said openings are disposed in at least one axial row and at least one circumferential row.

5. The apparatus of claim 1, comprising:

said at least one opening comprises a plurality of openings that are circumferentially spaced.

6. The apparatus of claim 1, comprising:

said at least one opening comprises a screen.

7. A tubular apparatus configured for connection to a tubular string extending to a subterranean location, said tubular string comprising a wall defining an outer surface and an innermost passage extending the length of the tubular string therethrough and defined on an opposite side of said wall from the outer surface, comprising:

at least one body having opposed ends for mounting to the tubular string in at least one location, said body covering at least one wall opening from within said innermost passage or in the wall of the tubular string, said wall opening initially held closed by said body that further comprises a degradable material, to block flow in opposed directions so that pressure can be conducted between said opposed ends;

said degradable material of said body selectively opening said wall opening while having remained in a fixed position relative to the tubular string for fluid flow through said wall opening;

said degradable material comprises a sleeve that initially covers over said opening.

8. A tubular apparatus configured for connection to a tubular string extending to a subterranean location, said tubular string comprising a wall defining an outer surface and an innermost passage extending the length of the tubular string therethrough and defined on an opposite side of said wall from the outer surface, comprising:

at least one body having opposed ends for mounting to the tubular string in at least one location, said body covering at least one wall opening from within said innermost passage or in the wall of the tubular string, said wall opening initially held closed by said body that further comprises a degradable material, to block flow in opposed directions so that pressure can be conducted between said opposed ends;

said degradable material of said body selectively opening said wall opening in the tubular string for fluid flow through said wall opening;

said degradable material is disposed between an inner and an outer tubular that comprise said at least one body, said inner and outer tubular bodies each having said at least one opening whereby said openings in said inner and outer tubulars open at least in part when said degradable material degrades.

9. The apparatus of claim 8, comprising:

said at least one opening in each said inner and outer tubulars are fully aligned or partly misaligned.

10. A tubular apparatus configured for connection to a tubular string extending to a subterranean location, comprising:

at least one body having opposed ends for mounting to the tubular string in at least one location, said body covering at least one wall opening on the tubular string initially held closed by a degradable material from which said body is made so that pressure can be conducted between said opposed ends;

said degradable material selectively opening said wall opening in the tubular string for fluid flow through said wall opening;

said degradable material comprises a sleeve that initially covers over said opening;

said sleeve is slidably mounted to selectively move with respect to said tubular body.

11. The apparatus of claim 10, comprising:

sliding of said sleeve at least in part opens said at least one opening.

12. The apparatus of claim 10, comprising:

said degradable material comprises a controlled electrolytic material or a degradable polymer or composite.

13. A completion or production method, comprising:

providing at least one segment of a string having a passage extending the length of said segment with at least one segment wall opening initially held closed with a degradable material sleeve mounted in said passage or in said segment wall to selectively block flow through said at least one wall opening in opposed directions;

conducting pressure through said segment of said string to perform a first operation;

degrading the degradable material sleeve without having moved said degradable material sleeve relative to said string to open said at least one opening and perform a second operation with flow through said at least one opening.

14. The method of claim 13, comprising:

making said second operation at least one of fracturing, acidizing, treating, injection or production.

15. The method of claim 13, comprising:

using a controlled electrolytic material as said degradable material.

16. The method of claim 13, comprising:

providing a plurality of said openings in the form of a screen or an array of axially or circumferentially spaced openings that are in the shape of holes or slots.

17. The method of claim 13, comprising:

configuring said at least one segment of said string with multiple walls on opposed sides of said degradable material sleeve or an inner said degradable material sleeve to cover said at least one opening.

* * * * *